US009111520B2

(12) United States Patent
Graber

(10) Patent No.: US 9,111,520 B2
(45) Date of Patent: Aug. 18, 2015

(54) FLEXURAL DISK TRANSDUCER SHELL

(71) Applicant: Curtis E. Graber, Woodburn, IN (US)

(72) Inventor: Curtis E. Graber, Woodburn, IN (US)

( * ) Notice: Subject to any disclaimer, the term of this patent is extended or adjusted under 35 U.S.C. 154(b) by 364 days.

(21) Appl. No.: 13/796,774

(22) Filed: Mar. 12, 2013

(65) Prior Publication Data

US 2014/0269211 A1 Sep. 18, 2014

(51) Int. Cl.

| | |
|---|---|
| ***G10K 9/12*** | (2006.01) |
| ***B06B 1/06*** | (2006.01) |
| ***G10K 11/02*** | (2006.01) |

(52) U.S. Cl.

CPC ..... *G10K 9/121* (2013.01); *B06B 1/0603* (2013.01); *G10K 11/025* (2013.01)

(58) Field of Classification Search

CPC ..... G10K 9/121; G10K 11/025; B06B 1/0603
USPC ..... 367/174
See application file for complete search history.

(56) References Cited

U.S. PATENT DOCUMENTS

| | | | | |
|---|---|---|---|---|
| 3,028,927 | A | 4/1962 | Levy et al. | |
| 4,190,783 | A | 2/1980 | Massa | |
| 4,190,784 | A | 2/1980 | Massa | |
| 4,429,247 | A | 1/1984 | Feldman | |
| 4,700,100 | A | 10/1987 | Congdon et al. | |
| 4,709,361 | A | 11/1987 | Dahlstrom et al. | |
| 4,713,799 | A | 12/1987 | Phelan et al. | |
| 4,811,816 | A | 3/1989 | Lin | |
| 6,298,012 | B1 | 10/2001 | Benjamin | |
| 6,341,661 | B1 | 1/2002 | Bick et al. | |
| 6,715,200 | B2 | 4/2004 | Feist et al. | |
| 2009/0003123 | A1 | 1/2009 | Morrison, Jr. | |
| 2009/0241753 | A1 | 10/2009 | Mann | |
| 2014/0198622 | A1* | 7/2014 | Graber | 367/176 |
| 2014/0269211 | A1* | 9/2014 | Graber | 367/174 |

OTHER PUBLICATIONS

Young, A.M. and Henriquez, T.A., Underwater Helmholtz Resonator Transducers for Low Frequency, High Power Applications, Proceedings of the Institute of Acoustics, Apr. 1987, pp. 52-57, vol. 9, Part 2, University of Bath, Bath, United Kingdom.

Woollett, Ralph S., Underwater Helmholtz-Resonator Transducers: General Design Principles, Jul. 5, 1977, Naval Underwater Systems Center, New London, Connecticut.

Tressler, James F., Piezoelectric Transducer Designs for Sonar Applications, from Piezoelectric and Acoustic Materials for Transducer Applications, Safari and Akdogan, editors, 2008, Springer Science+Business Media, LLC, New York, New York.

Gabrielson, Thomas B., An Equivalent-Circuit Model for Flexural-Disk Transducers, Jan. 29, 2003, The Pennsylvania State University Applied Research Laboratory, State College, Pennsylvania.

* cited by examiner

*Primary Examiner* — Daniel Pihulic
(74) *Attorney, Agent, or Firm* — Taylor IP, P.C.

(57) ABSTRACT

A flexural disk transducer is located in a shell or enclosure primarily for underwater use. Compression chambers adjacent to the transducer capture sound from bands on the disk and waveguides are used to direct the sound forward along a single propagation axis. An acoustic delay line is built into one waveguide to compensate for phase differences between the bands.

11 Claims, 6 Drawing Sheets

FLEXURAL DISK TRANSDUCER SHELL

BACKGROUND

1. Technical Field

The field relates to flexural disk transducers and more particularly to a shell or enclosure providing improved efficiency in operation.

2. Description of the Problem

Flexural disk transducers are usually constructed as metal/ceramic bi-laminar (or tri-laminar), vibratile electroacoustic transducers. Early versions were placed in housings in which they were mounted along their perimeters and which included an acoustic shield which left only the central portion of one major transducer surface of the piezoelectric ceramic exposed to the transmission medium such as water or air. This was done due to inner and outer portions of the disk operating out of phase with one another when the disk was operated in its free fundamental resonance mode. Shielding a portion of the disk mitigated destructive interference between the different sections of the disk.

Use of such shields was known to reduce the efficiency of such devices. This loss of efficiency was addressed in U.S. Pat. No. 4,190,783 which was directed to device for use in air in which the shield or plate was displaced from the transducer surface and sized so that sound produced along the peripheral edge reached a central aperture in phase with sound produced at the center of the device. The plate functioned to introduce a time delay for the sound generated by the peripheral portions of the disk allowing them to be constructively added to vibrations generated in the center of the disk. In this way most of the sound energy produced along one face of a disk could be captured.

Flexural disk transducers have been applied to underwater applications as well, particularly as high frequency acoustical sources. In such applications it has been supported along its edges so that the disk vibrates in a flexural mode similar to the bottom of an oil-can when depressed to force out oil.

SUMMARY

A sound generating and propagating device includes a flexural disk transducer having front and reverse major surfaces and a primary resonant frequency of operation. A ring compression chamber is located adjacent a band on the front major surface and a band on the reverse major surface to capture sound generated off either or both bands. First and second waveguides are connected to the ring compression chamber with the first waveguide providing coupling of sound captured from the band on the front major surface to the environment forward along a propagation axis and the second waveguide providing for coupling of sound captured from the band on the reverse major surface forward along the propagation axis.

BRIEF DESCRIPTION OF THE DRAWINGS

Understanding of the following description may be enhanced by reference to the accompanying drawings wherein.

DETAILED DESCRIPTION

Figure 1:
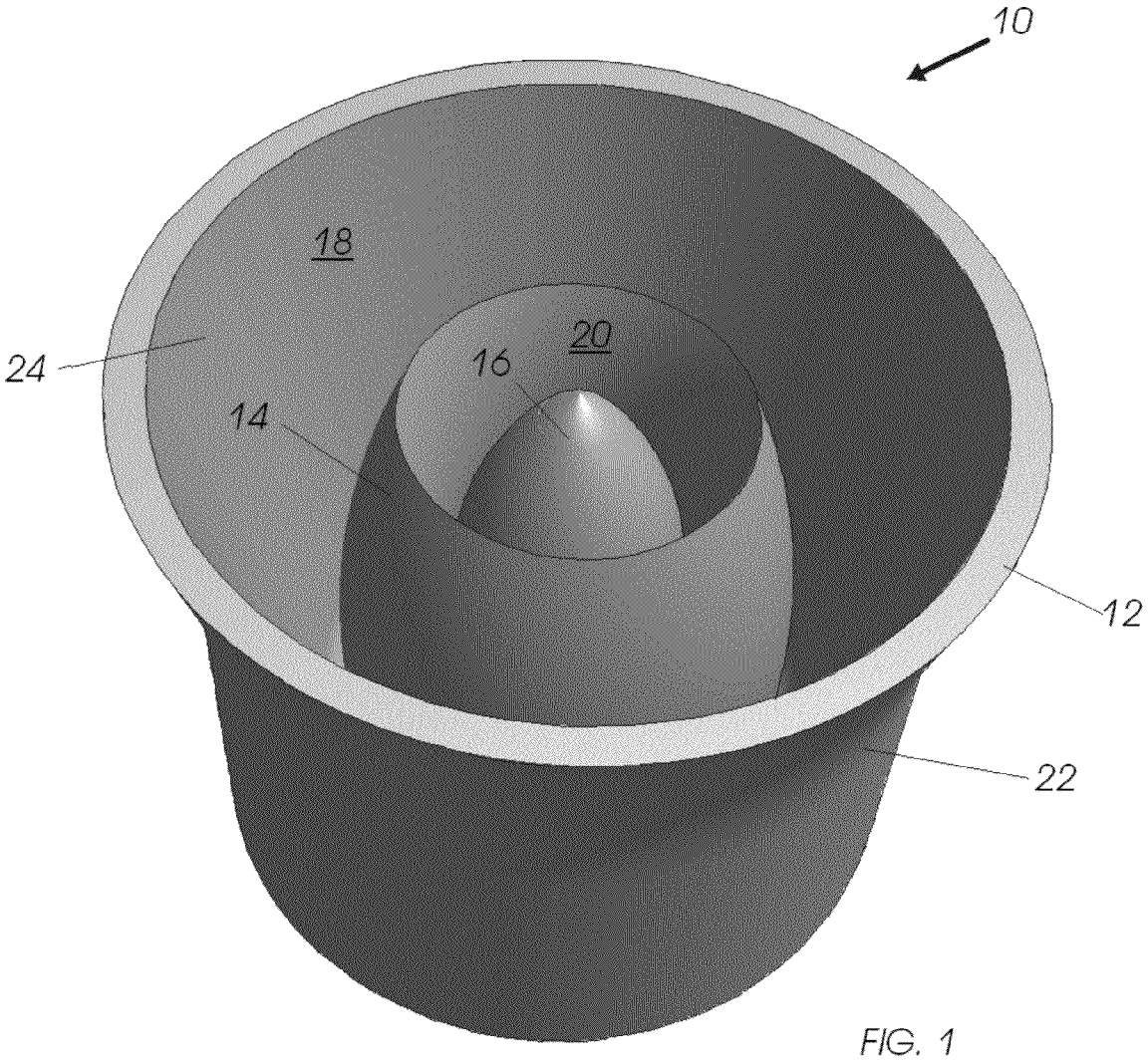
FIG. 1 is a perspective view of a flexural disk transducer shell.

The FIGURES illustrate an acoustic transducer assembly 10. Assembly 10 comprises a shell 12 which has a cylindrical section 22 opening outwardly toward one end to define an assembly mouth 24. A perimeter mouth 18 and a center mouth 20 are displaced inwardly from assembly mouth 24 and channel sound into the assembly mouth for constructive summation. Shell 12 may be made of any suitable material such as, but not limited to, aluminum.

Figure 2:
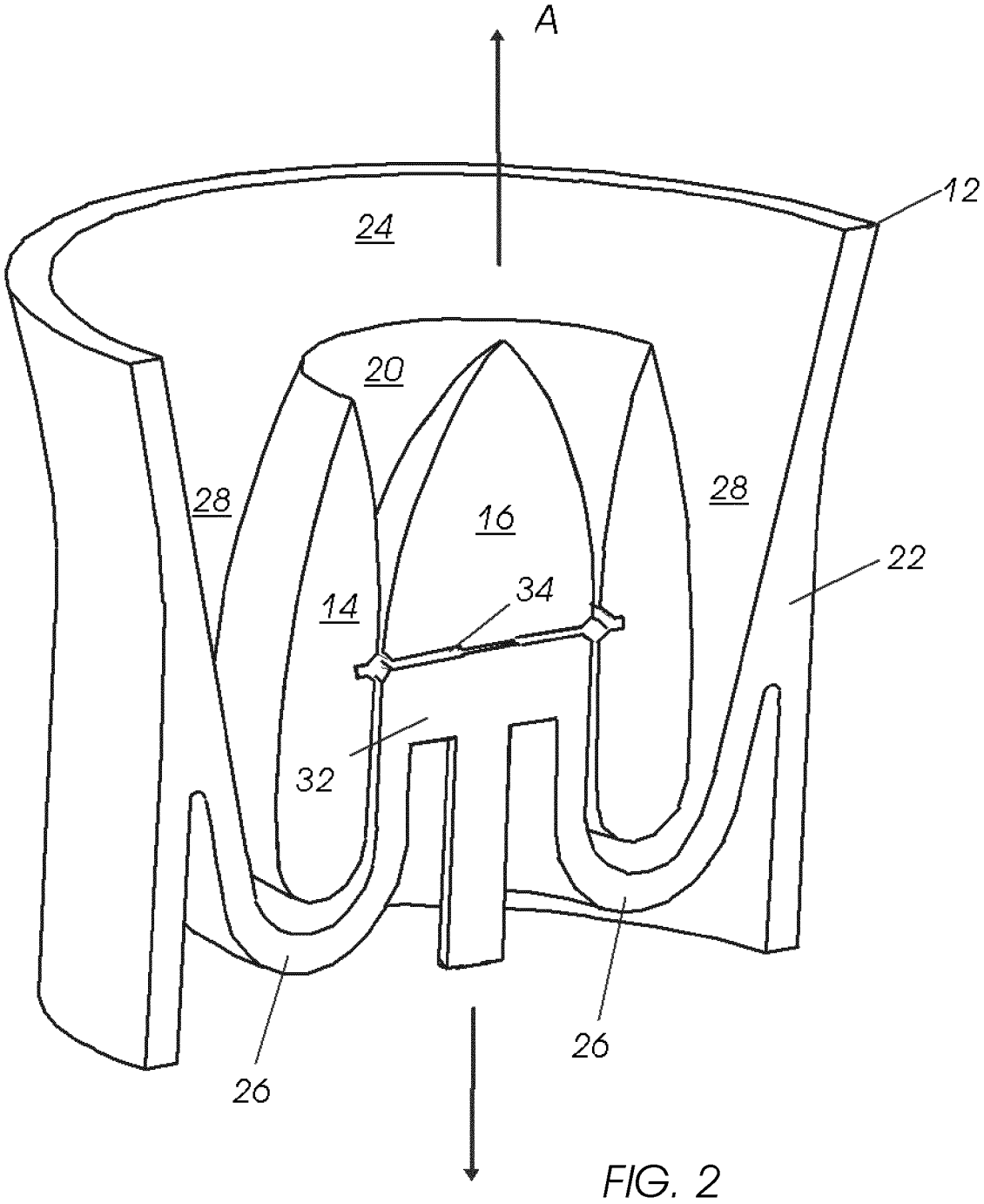
FIG. 2 is a perspective cutaway view of the flexural disk transducer shell of FIG. 1.

Perimeter mouth 18 is defined between an outer phase plug 14 and cylindrical section 22. Center mouth 20 is defined between the outer phase plug 14 and an inner phase plug 16. Referring to FIGS. 1 and 2 it may be seen that outer phase plug 14 has a generally toroidal shape, but one which is elongated in a direction parallel to a propagation axis "A" for sound from the device. The outer phase plug 14 is pointed at one end in its direction of elongation. The outer phase plug 14 defines a hollow central core with the propagation axis corresponding to the center of the hollow center core. The pointed end of the outer phase plug 14, adjacent to and between the perimeter and center mouths 18, 20, forms a wedge. Inner phase plug 16 is located centered on the propagation axis in the hollow center of the outer phase plug 14. Inner phase plug 16 is generally cone or bullet shaped and pointed toward the open end of shell 12 corresponding to a combined or common mouth 24 from waveguides 28 and 30. Sound from the device is emitted outwardly from combined mouth 24 or forward along the propagation axis A.

Outer phase plug 14 is nested in the bowl of an open semi-torus formed by section 26 of shell 12. Section 26 has a semi-circular cross section and forms a closed loop extending between the cylindrical section 22 and a base element to inner phase plug 16. A gap is left between the base of the outer phase plug 14 and the inner surface of the section 26 to form a serpentine waveguide 28 for the reverse major surface 50B of the flexural disk 34. The gap between the outer phase plug and the inner phase plug defines a straight waveguide 30 for the front major surface 50A of the flexural disk 34. The throats 29 and 31 (See FIG. 5) to waveguides 28 and 30 are juxtaposed across a ring compression chamber 46. Acoustic transducer 10 has a design wavelength at its selected operating frequency which defines the relative lengths of the serpentine waveguide 30 and the straight waveguide 30. Serpentine waveguide 30 is nominally one half wavelength longer than straight waveguide, or some odd whole number multiple of half a wavelength, to produce in phase sound at combined mouth 24. A typical length for straight wave guide 30 could be ¾ of a wavelength though other lengths are possible beginning generally with a minimum length of ¼ wavelength. For a straight wave guide of ¾ wavelength the serpentine waveguide 38 is generally constructed to have a wavelength of 1 and ¼ wavelengths. Serpentine waveguide 30 reverses the direction of propagation of sound introduced at its throat 29. While the depicted embodiment is intended for use in are it may be modified for underwater use in which case both of waveguides 28 and 30 are flooded.

Figure 3:
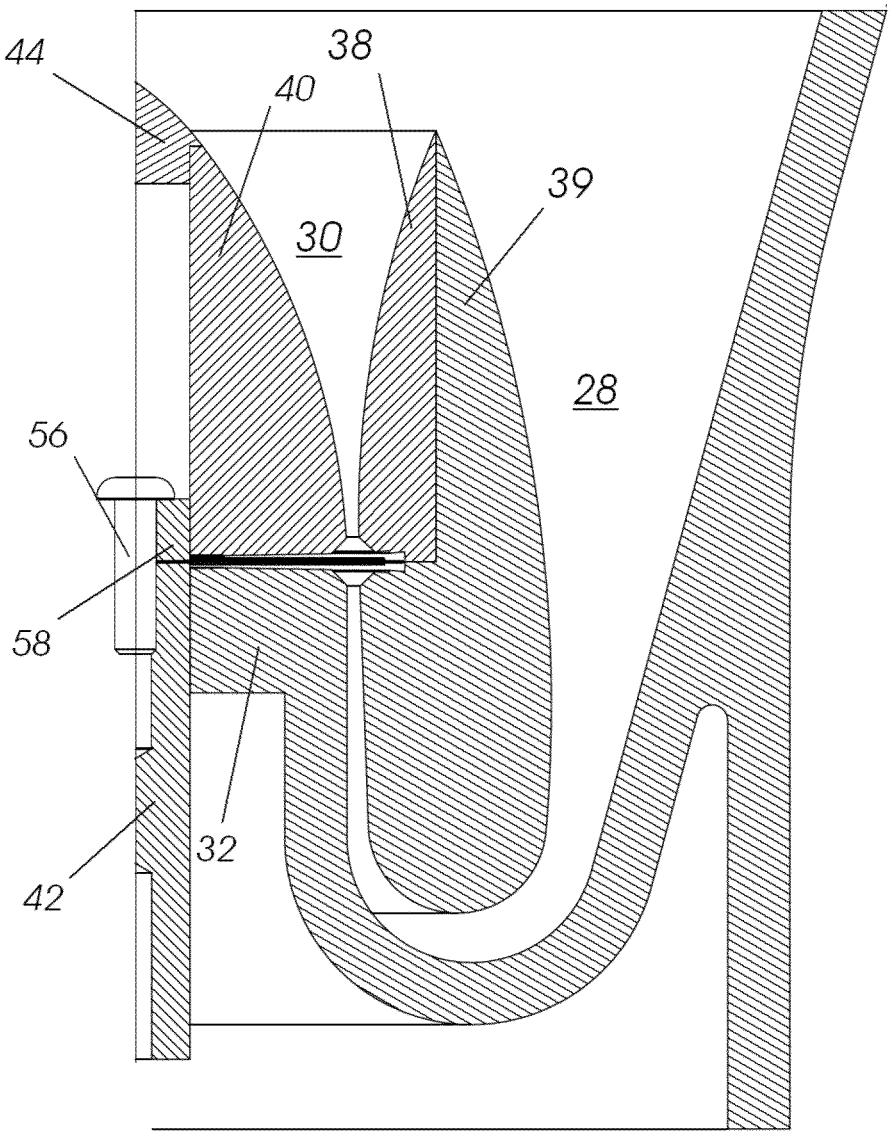
FIG. 3 is a partial cross section view of the flexural disk transducer shell.

A flattened cylindrical cavity 34 which includes compression chamber ring 46 is provided within shell 12. The central portion of cylindrical cavity 34 is defined by a gap between inner phase plug main body 40 (See FIG. 3) and inner phase plug base 32. It extends to include a small notch radially outside of ring compression chamber 46 in a gap between an inner section to outer phase plug 14 and the main body 39 of the outer phase plug.

Suspended within cylindrical cavity 34 is a flexural disk transducer 36. Flexural disk transducer 36 is supported at its center on a central shaft 42 inserted through a hole through inner phase plug base 32 into inner phase plug main body 40. A screw 56 and ring 58 complete the suspension assembly and a cap 44 closes the hollow central core of the inner phase plug main body 40. Wiring connections to the flexural disk transducer 36 are not shown but are conventional. Sound is generated from both major faces 50A and 50B of the disk transducer 36 but 180 degrees out of phase.

Ring compression chamber 46 captures sound from both major surfaces 50A and 50B (front and reverse) of flexural disk transducer 36. The regions of capture correspond to bands on the major surfaces substantially displaced from the center of the flexural disk transducer 36 and substantially adjacent to the outer perimeter of the disk. Sound generated from one face is 180 degrees out of phase with sound produced from the face opposite.

Figure 4:
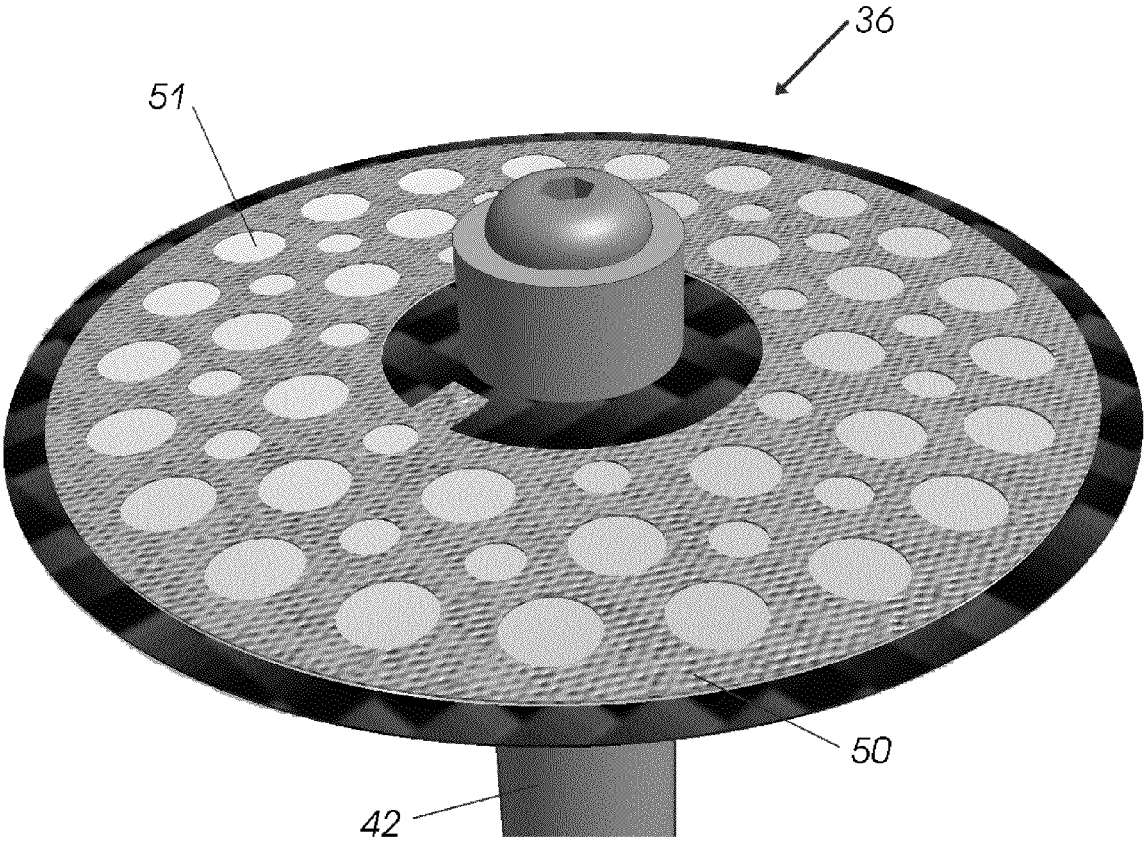
FIG. 4 is a perspective of a flexural disk transducer.
Figure 5:
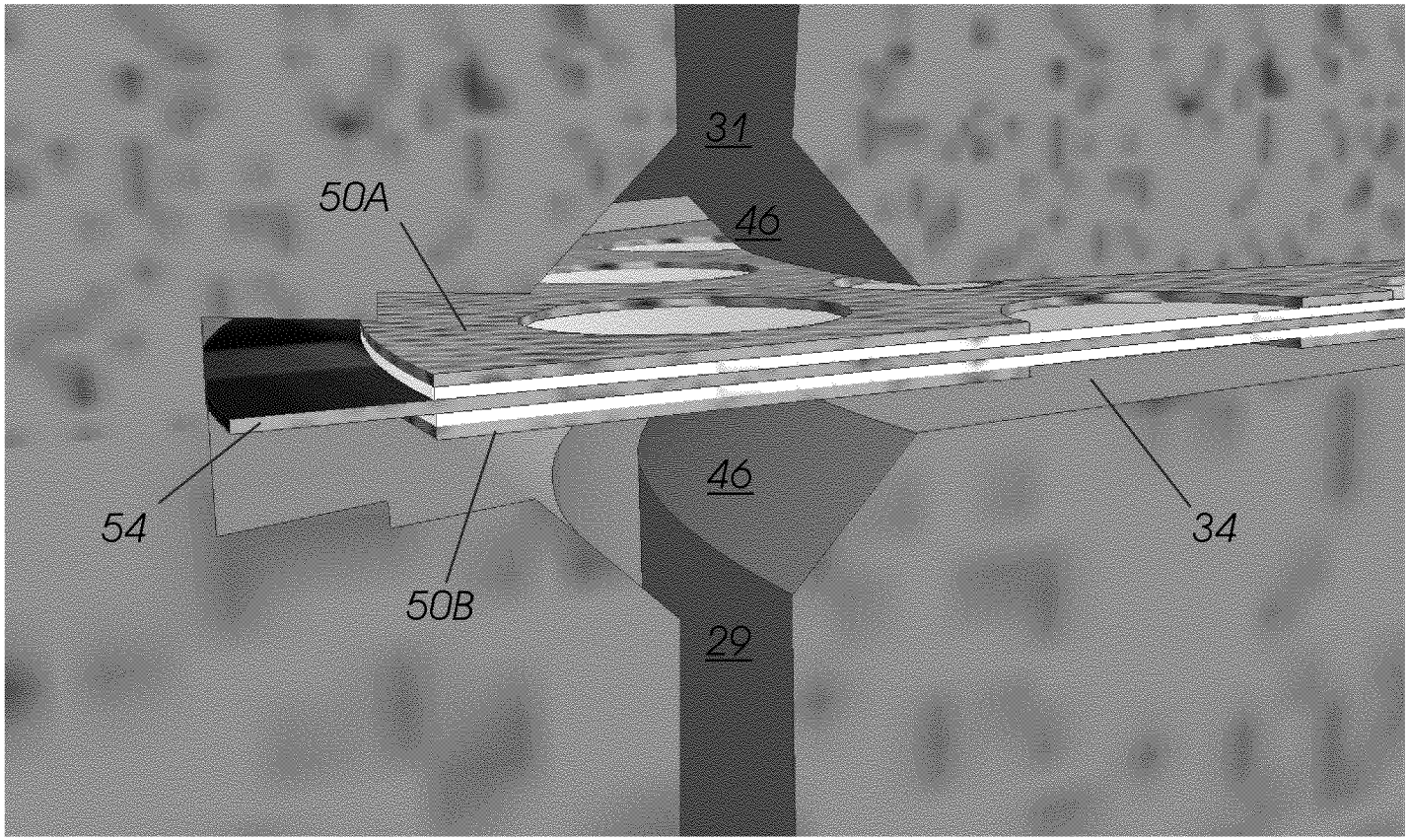
FIG. 5 is a perspective cutaway view of a flexural disk transducer as located in the transducer shell.
Figure 6:
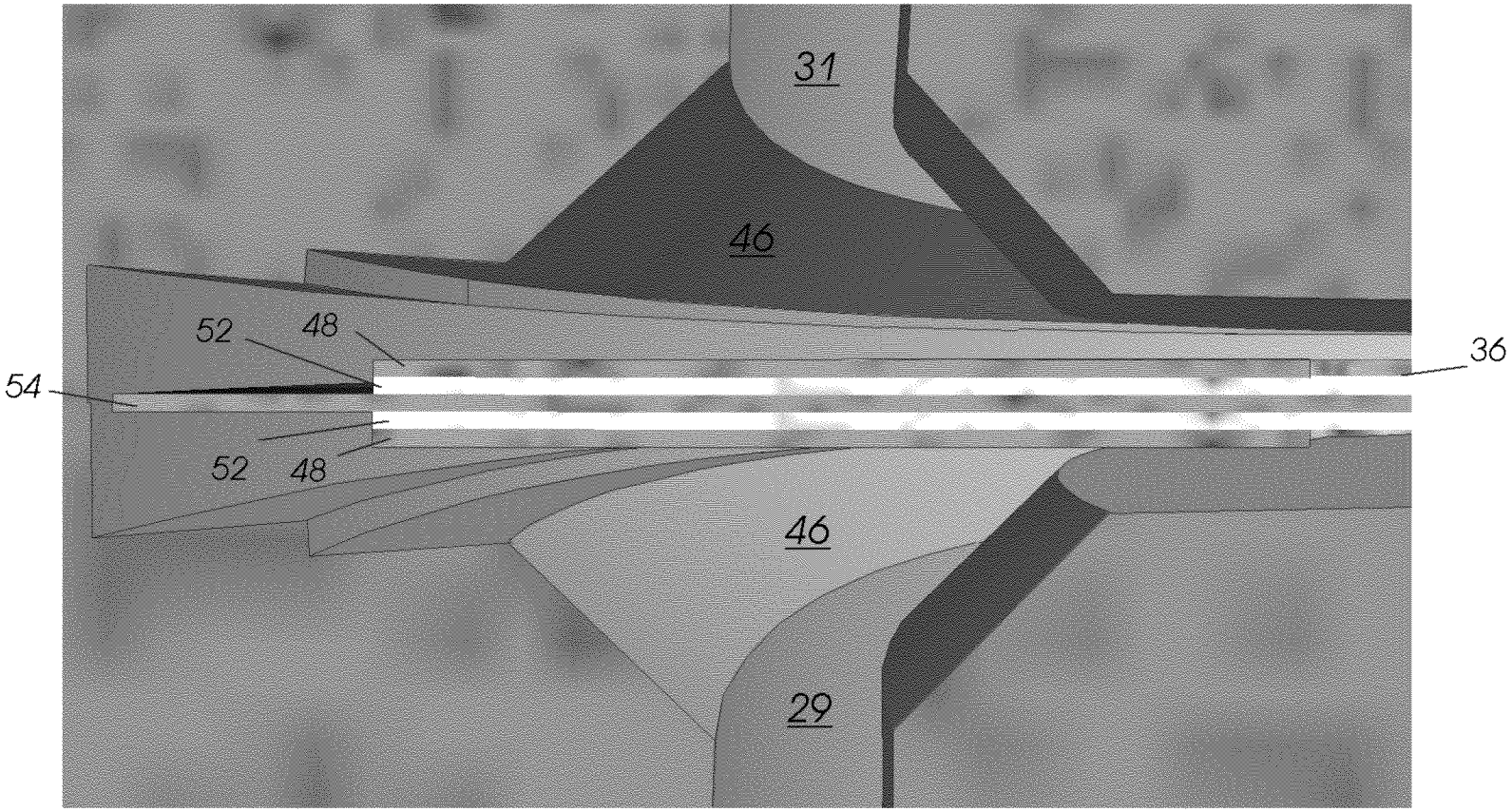
FIG. 6 is a cross-section view of a flexural disk transducer as located in the transducer shell.

Referring to FIGS. 4-6 the flexural disk transducer 36 comprises several layers. A center carrier 54 is made of either metal alloy or carbon-fiber cross grained resin impregnated laminated composites. Carbon-fiber has stiffer lower mass characteristics for highest efficiency. Materials such as Kevlar or fiberglass could be substituted. Layers 52 are piezoelectric crystals and, if like kind, are electrically polled opposite. It is possible that layers 52 could be different types of crystals exhibiting usable piezoelectric properties in which case they are electrically poled to produce a summed bending function to the carrier 54 at a desired frequency. The outer layers 48 are a micro mesh stainless steel screen with perforations 51 to lower mass in the matrix. The layers are glued to one another with electrically conductive adhesives. A carbon-fiber carrier 54 uses a metalized thin film on both sides to allow it to efficiently pass electricity to the crystal 52 surfaces adhered to it. If an electrically conductive carrier is used the metalized thin film is not used. Stiffer lighter weight composites result in higher frequency of natural resonance. A metal alloy carrier 54 can be aluminum or other material depending on the tuned resonance chosen for the target frequency, heavier softer alloys result in lower frequency of natural resonance.

Flexural disk transducer 36 is bolted (See FIG. 3) to the center of the transducer assembly 10 so that the disk is essentially pinned in the middle forcing the bi-morph to move the outer surface area in a toroid fore and aft direction with the application of electrical voltage and current supplied to the core carrier 54 (negative) and the outer mesh stainless screen 48 on both sides of the crystal wafer stack. Like type piezoelectric crystals 52 are polled opposite to allow the electrically opposite condition of one crystal to reinforce the direction of the other crystal. Many variants of piezoelectric ceramics are commonly used depending on the specific application use of the transducer. One such crystal material is lead zirconate titanate.

The highly resonant disk transducer with a selected frequency of resonance matched to several other acoustic elements in the topology. The use of a center pinned transducer matrix where the voltage applied to the transducer excites the wafer to move in a toroid bending function with no dampening of the excited ring transducer outside of the center mounting point. Piston like modes are set up in the resonant crystal which tends to remain linear in acoustic phase around its outer circumference. Transducer acoustic load is harvested from the area of largest peak xmax (piston+/−travel) which is also the area of largest surface square area resulting in efficiency increases as compared to a typical piezoelectric element that is pinned around the outer edge and the acoustic energy is harvested from the center of the wafer the point of highest xmax but also the area of smallest square surface area. Front/back harvested area is coupled to a compression chamber 46 of size to provide good acoustic impedance leverage and an increase in velocity. It is possible to harvest sound energy from just the front or reverse face 50A, 50B.

Compression chamber 46 is coupled to the differential waveguides with the forward waveguide being shorter in length than the waveguide for the reverse major surface by ½ the wave length (or a odd whole number multiple thereof) of the primary resonance of the transducer. This makes the waveguide for the reverse major surface (in the present embodiment the serpentine waveguide 28 serves this function) a time delay or phase adjustment element. The waveguide for the reverse major surface bends its path forward to be summed to the front wave. When the device is operated at its resonant frequency sound passing through the two waveguides arrives in phase for wave summing and coherent in-phase acoustic propagation. There exists an option to mis-tune the rear wave to front wave at a given frequency to narrow or widen the acoustic beam generated by virtue of phasing the concentric acoustic apertures in a mechanical beam forming. Alternately one of waveguides could contain an adjustable length design (such as a valve or slide arrangement) to allow the end user to mechanically change the effective length of the waveguide relationship between the inner and outer waveguides.

What is claimed is:

1. A sound generating and propagating apparatus comprising:

a flexural disk transducer having front and reverse major surfaces and a primary resonant frequency of operation;

a ring compression chamber located adjacent a band on the front major surface and a band on the reverse major surface to capture sound generated off the bands; and first and second waveguides connected to the ring compression chamber with the first waveguide providing coupling of sound captured from the band on the front major surface to the environment forward along a propagation axis and the second waveguide providing for coupling of sound captured from the band on the reverse major surface forward along the propagation axis.

2. The apparatus of claim 1, further comprising:

the first waveguide having a length corresponding to a whole number fraction of the wavelength of the primary resonant frequency;

the second waveguide having a length equal to the length of the first waveguide plus a length corresponding to an odd whole number times one half the wavelength of the primary resonant frequency.

3. The apparatus of claim 1, further comprising:

the second waveguide having a selectable length to allow for full or partial constructive summation of sound transmitted by the first and second waveguides to control beam spread.

4. The apparatus of claim 2, further comprising:

the second waveguide having a serpentine path to provide for reversing the direction of sound propagation.

5. A flexural disk transducer assembly, the assembly comprising:

an outer shell defining an acoustic mouth;

an inner phase plug centered within in the outer shell;

an outer phase plug located within and space from the outer shell and surrounding and spaced from the inner phase plug;

a forward waveguide having a length defined between the inner phase plug and the outer phase plug;

a reverse waveguide having a length defined between the outer phase plug and the shell;

the forward and reverse waveguides meeting at the acoustic mouth for directing sound forward from both the forward and the reverse waveguides along a common propagation axis;

a ring compression chamber located between throats into the forward and reverse waveguides;

a flexural disk transducer centered in and located to radiate into the compression chamber from each of two opposed major faces; and the lengths of the forward and reverse waveguides being selected to obtain a particular phase relationship in sound emitted from the waveguides at the common mouth.

6. The assembly of claim 5, further comprising:

the flexural disk transducer having a resonant frequency; and the lengths of the forward and reverse waveguides being determined by the wavelength of sound at the resonant frequency and selected to obtain constructive summation of sound from the opposed major faces of the flexural disk transducer at the acoustic mouth.

7. The assembly of claim 6, further comprising:

the reverse wave guide having a length selected to operate as a delay line relative to the forward wave guide at the resonant frequency.

8. The assembly of claim 6, further comprising:

the flexural disk transducer being center pinned and free along its perimeter.

9. The assembly of claim 6, further comprising:

the compression chamber being located along and substantially adjacent to the outer perimeter of the flexural disk.

10. A flexural disk transducer assembly, the assembly comprising:

an outer shell defining an acoustic mouth;

an inner phase plug centered within in the outer shell;

a forward waveguide formed in part along the inner phase plug;

the forward waveguide terminating at the acoustic mouth for directing sound along a propagation axis;

a flexural disk transducer center pinned and free along a perimeter;

a ring compression chamber located over a major face of the flexural disk transducer substantially adjacent the perimeter; and a throat connecting the ring compression chamber to the forward waveguide.

11. The assembly of claim 10, further comprising:

a reverse waveguide connected between the ring compression chamber ring and to the acoustic mouth having a length selected to operate as a delay line relative to the forward waveguide.

* * * * *